US010525761B2

(12) United States Patent
Kim

(10) Patent No.: US 10,525,761 B2
(45) Date of Patent: Jan. 7, 2020

(54) KNOCK TYPE PEN

(71) Applicant: DONG-A PENCIL CO., LTD., Seoul (KR)

(72) Inventor: Hakjae Kim, Seoul (KR)

(73) Assignee: DONG-A PENCIL CO., LTD., Seoul (KR)

( * ) Notice: Subject to any disclaimer, the term of this patent is extended or adjusted under 35 U.S.C. 154(b) by 12 days.

(21) Appl. No.: 15/857,130

(22) Filed: Dec. 28, 2017

(65) Prior Publication Data

US 2019/0160851 A1 May 30, 2019

(30) Foreign Application Priority Data

Nov. 24, 2017 (KR) ..... 10-2017-0158435

(51) Int. Cl.

| | |
|---|---|
| ***B43K 24/04*** | (2006.01) |
| ***B43K 7/12*** | (2006.01) |
| ***B43K 24/08*** | (2006.01) |
| ***B43K 24/06*** | (2006.01) |
| *B43K 24/02* | (2006.01) |

(52) U.S. Cl.
CPC ..... *B43K 24/04* (2013.01); *B43K 7/12* (2013.01); *B43K 24/084* (2013.01); *B43K 24/02* (2013.01); *B43K 24/06* (2013.01)

(58) Field of Classification Search
CPC ..... B43K 24/04; B43K 7/12; B43K 24/084; B43K 24/08; B43K 24/026; B43K 24/00; B43K 24/023; B43K 24/03; B43K 24/082; B43K 25/0024; B43K 25/028
See application file for complete search history.

(56) References Cited

U.S. PATENT DOCUMENTS 2,907,302 A * 10/1959 Raszl ..... B43K 24/08 401/104
6,200,050 B1 * 3/2001 Lin ..... B43K 24/08 401/104
7,931,415 B2 * 4/2011 Namiki ..... B43K 7/12 401/104

FOREIGN PATENT DOCUMENTS

KR 20-2016-0003130 9/2016

* cited by examiner

*Primary Examiner* — David J Walczak

(57) ABSTRACT

A knock type pen includes a body in which a lead and a spring which provides an elastic force to the lead are received, and a knock section which is coupled to a rear end of the body and includes a knock body and a rotary cam to push the lead out of a tip of the body or receive the lead inside, wherein the knock type pen includes a cutout groove which extends in one direction along an axial direction of the body, a slit hole which extends along a downward direction from an upper end of the cutout groove, an insert hole which is formed in a direction perpendicular to the slit hole from the upper end of the cutout groove, and a locking section which moves up and down along the slit hole.

3 Claims, 7 Drawing Sheets

< Prior Art >

< Prior Art >

< Prior Art >

< Prior Art >

KNOCK TYPE PEN

CROSS-REFERENCE TO RELATED APPLICATION

This application claims priority of Korean Patent Application No. 10-2017-0158435, filed on Nov. 24, 2017, in the KIPO (Korean Intellectual Property Office), the disclosure of which is incorporated herein entirely by reference.

BACKGROUND OF THE INVENTION

Field of the Invention

The present disclosure relates to a knock type pen, and more particularly, to a knock type pen for preventing ink from leaking through the nib pushed out by a user's unintentional knock pressing and leaving stains on clothes or a bag.

Description of the Related Art

In general, a pen can be classified into a fixed type pen in which the lead is fixed and the nib is exposed to the outside or concealed using an opening/closing cap, a rotary type pen in which as a part of the shaft rotates, the lead makes a linear movement and accordingly the nib is pushed in and out, a knock type pen in which when a part of the shaft is pressed, a spring moves to push the nib out, and a slide type pen in which the lead slides the nib to push the nib in and out.

Among them, the knock type pen is convenient because of pushing the nib in and out in a simple manner through a motion of pressing a button section provided on the top of a housing.

This knock type pen is configured such that when the button section provided on the top of the housing is pressed once, the nib extends outside, turning into a writable state, and when the button section is pressed once again, the extended nib retracts into the housing, turning into a reception and protection state.

FIG. 1 is a diagram showing a conventional knock type pen, and FIG. 2 is an exploded view of a knock mechanism of the knock type pen of FIG. 1.

As shown in FIG. 1, the conventional knock type pen 10 is configured such that a lead 12 storing ink is received in a housing 11, and a knock body 15 which is manipulated moveably up and down is protrusively coupled to a slot (not shown) formed on the inner sidewall of the housing 11 in the upper part of the housing 11.

Furthermore, a rotary cam 16 is rotatably placed between the lead 12 and the knock body 15, and the knock body 15 and the rotary cam 16 form a knock mechanism 14 whereby the lead 12 is allowed to advance and draw back.

Moreover, a spring 21 is placed between the housing 11 and the lead 12 to apply an elastic force to the lead 12 in a direction in which the nib 13 retracts into the housing 11.

When a user presses a button section 17 protruding out of the housing 11 of the knock body 15, the lead 12 moves down and the nib 13 protruding at the end is pushed out of the housing 11.

In this instance, a guide protrusion 20 of the rotary cam 16 that comes into contact with a toothed protrusion 18 at the bottom of the knock body 15 slips out of the slot of the housing 11, and at the same time, slips out of one slope surface of the toothed protrusion 18 while rotating along the other slope surface, and the rotated guide protrusion 20 of the rotary cam 16 is stuck by a stopper step 19 protruding from the outer circumference of the knock body 15.

In this state, despite the elastic force of the spring 21 coupled to the nib 13, the lead 12 does not move up, so the nib 13 keeps being extended outside the housing 11.

When the nib 13 is extended outside, if the user presses the button section 17 again, the rotary cam 16 rotates by the method previously described so that the guide protrusion 20 of the rotary cam 16 is disposed between the stopper steps 19 of the knock body 15 and moves up by the elastic force of the spring 21 and thus the nib 13 retracts into the housing 21.

However, the conventional knock type pen designed as above has a problem that when it is put on the user's clothes, for example, a pocket using a clip 22 provided on the side of the upper end of the housing 11, or when it is put in a bag, the nib 13 is pushed out by the user's unintentional knock pressing, and ink leaks through the nib 13 extended outside, causing ink stains on the clothes or the bag.

In particular, recently, many knock type pens containing low viscosity ink to facilitate writing with a small force (pressure) are being offered. However, compared to high viscosity ink, low viscosity ink leaks in a higher amount from the nib due to the low viscosity, and when the nib is pushed out by an unintentional knock pressing as described above, larger ink stains leave on clothes or a bag because of better ability of absorption, resulting in more serious damage.

Additionally, the conventional knock type pen designed as above has a problem that when it is put on the user's clothes, for example, a pocket using a clip 22 provided on the side of the upper end of the housing 11 as shown in FIG. 3, or when it is put in a bag as shown in FIG. 4, the nib 13 is pushed out by the user's unintentional knock pressing, and ink leaks through the nib 13 extended outside, causing ink stains on the clothes or the bag.

Korean Utility Model Publication No. 20-2016-0003130, published on Sep. 19, 2016, discloses a knock type pen.

SUMMARY OF THE INVENTION

The present disclosure is directed to providing a knock type pen for preventing ink from leaking through the nib pushed out by a user's unintentional knock pressing and leaving stains on clothes or a bag.

The present disclosure is further directed to providing a knock type pen for preventing contamination caused by a manipulation error in the knock type pen using low viscosity ink that is relatively vulnerable to contamination exposure compared to high viscosity ink.

The object of the present disclosure is not limited to the objects mentioned in the foregoing, and other objects not stated herein will be clearly understood by those skilled in the art from the following disclosure.

To achieve the object, a knock type pen according to an embodiment of the present disclosure includes a body in which a lead and a spring which provides an elastic force to the lead are received, and a knock section which is coupled to a rear end of the body and includes a knock body and a rotary cam to push the lead out of a tip of the body or receive the lead inside, wherein the knock type pen includes a cutout groove which extends in one direction along an axial direction of the body with a predetermined thickness relative to an outer diameter thickness of the body in the rear end part of the body, a slit hole which extends along a downward direction from an upper end of the cutout groove, an insert hole which is formed in a direction perpendicular to the slit hole from the upper end of the cutout groove, and a locking section which moves up and down along the slit hole, wherein when the operation of the knock section is in released state, the locking section limits a movement of the knock section in one direction to prevent the lead from being pushed out of the body.

In this embodiment, the locking section includes a movement plate which is formed in plate shape, has a hole to guide a movement of the lead, and moves up and down, a protrusion which extends in an outer radial direction of a width of the slit hole from an outer circumferential surface of the movement plate, and a guide plate having an inner circumferential surface coupled to a tip of the protrusion, wherein the guide plate is formed in a shape corresponding to a shape of an outer circumferential surface of the cutout groove and moves up and down along the cutout groove.

In this embodiment, the upper end of the cutout groove may have at least one semi-hole groove successively formed in a vertical direction along a circumferential direction of a contact area with the guide plate, and an upper end of the guide plate may have a projection in hemispheric shape temporarily fixed to the semi-hole groove at a position corresponding to a contact area with the semi-hole groove.

The knock type pen according to the present disclosure can prevent ink from leaking through the nib pushed out by a user's unintentional knock pressing and leaving stains on clothes or a bag.

In particular, in the case of use from low viscosity ink (300-3,000 cps) having relatively low viscosity to high viscosity ink (10,000-25,000 cps) having high viscosity, it can prevent ink from leaking out of the nib due to a knock pressing and leaving stains on clothes or a bag, and it can be applied to all writing instruments such as ballpoint pens employing low viscosity ink and high viscosity ink.

The effect of the present disclosure is not limited to the effects mentioned in the foregoing, and other effects not stated herein will be clearly understood by those skilled in the art from the following disclosure.

BRIEF DESCRIPTION OF THE DRAWINGS

The above and other features and advantages will become more apparent to those of ordinary skill in the art by describing in detail exemplary embodiments with reference to the attached drawings, in which.

Figure 1:
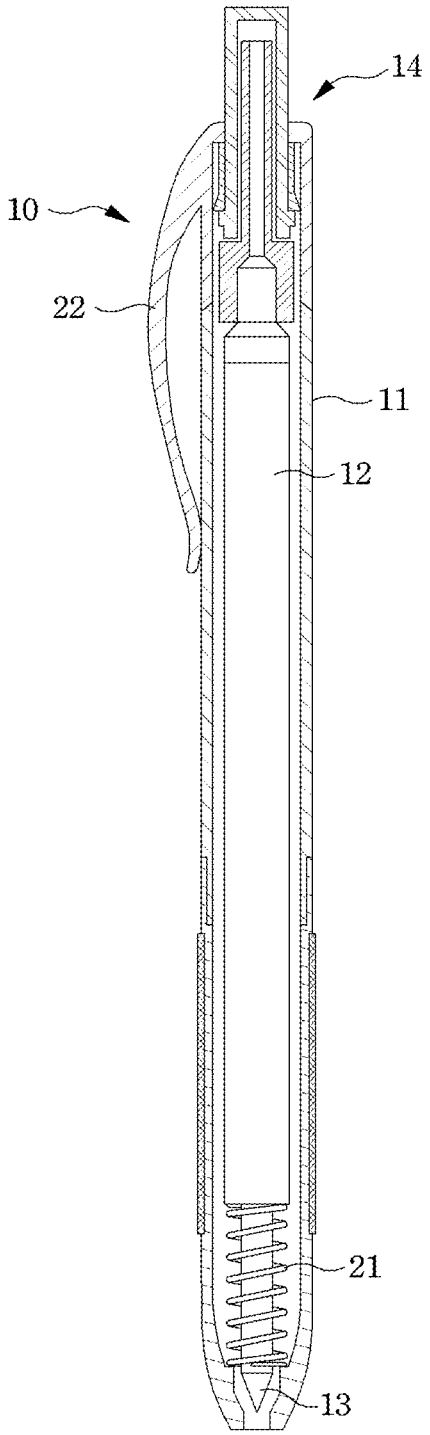
FIG. 1 is a diagram showing the conventional knock type pen.
Figure 2:
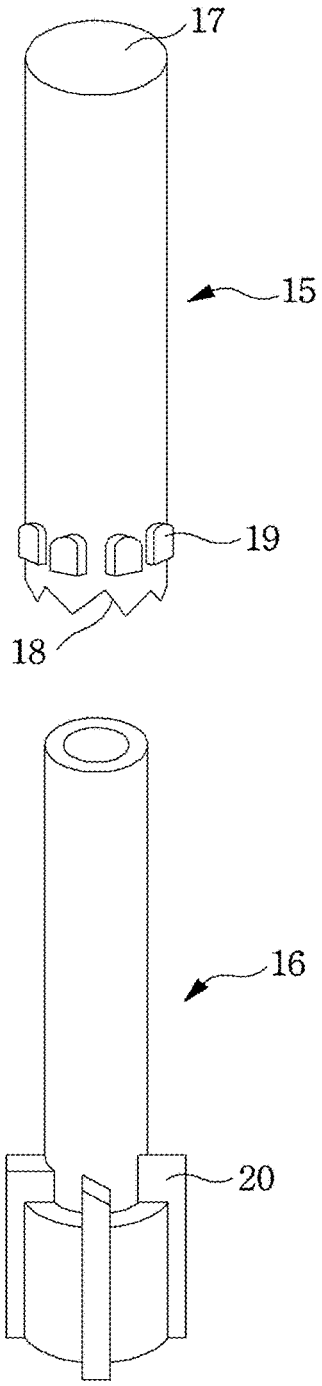
FIG. 2 is an exploded view of a knock mechanism of the knock type pen of FIG. 1.
Figure 3:
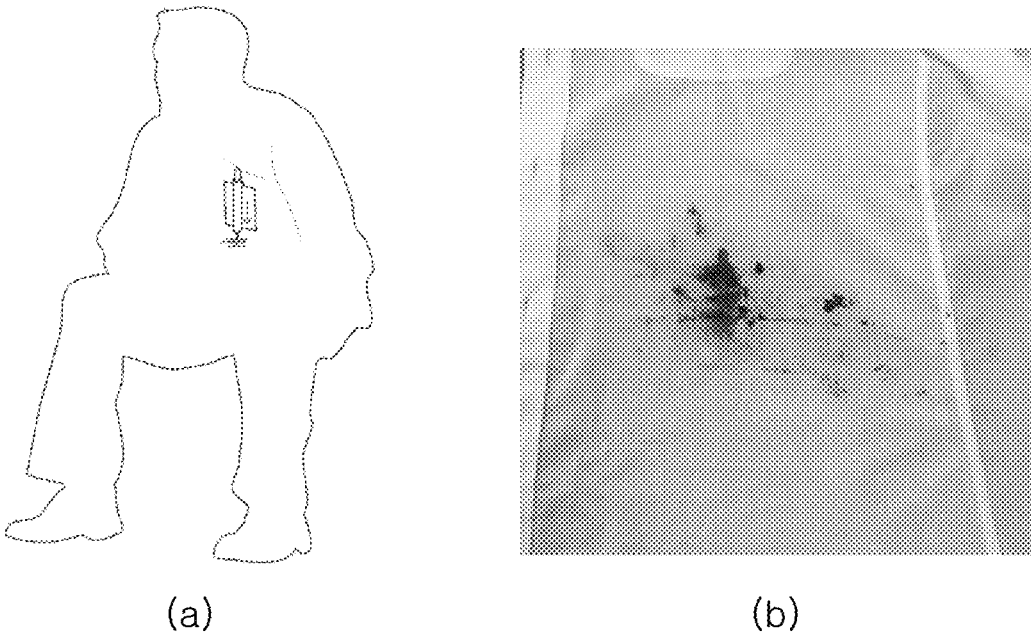

(a) in FIG. 3 is a diagram showing a shirt stained with ink due to ink leaks in the event that a button section of a knock type pen is pressed when a user puts the knock type pen on the shirt's pocket, and (b) is an enlarged view of the contaminated part in (a).

Figure 4:
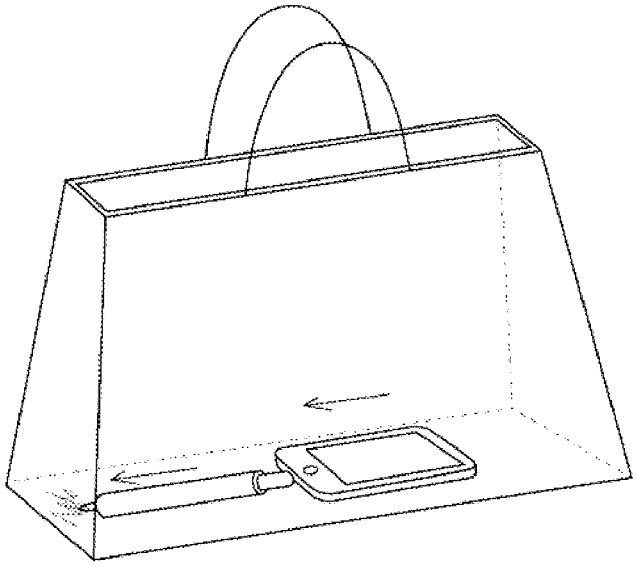

FIG. 4 is a diagram showing a bag stained with ink due to ink leaks in the event that a button section of a knock type pen is pressed when a user puts the knock type pen in the bag.

Figure 5:
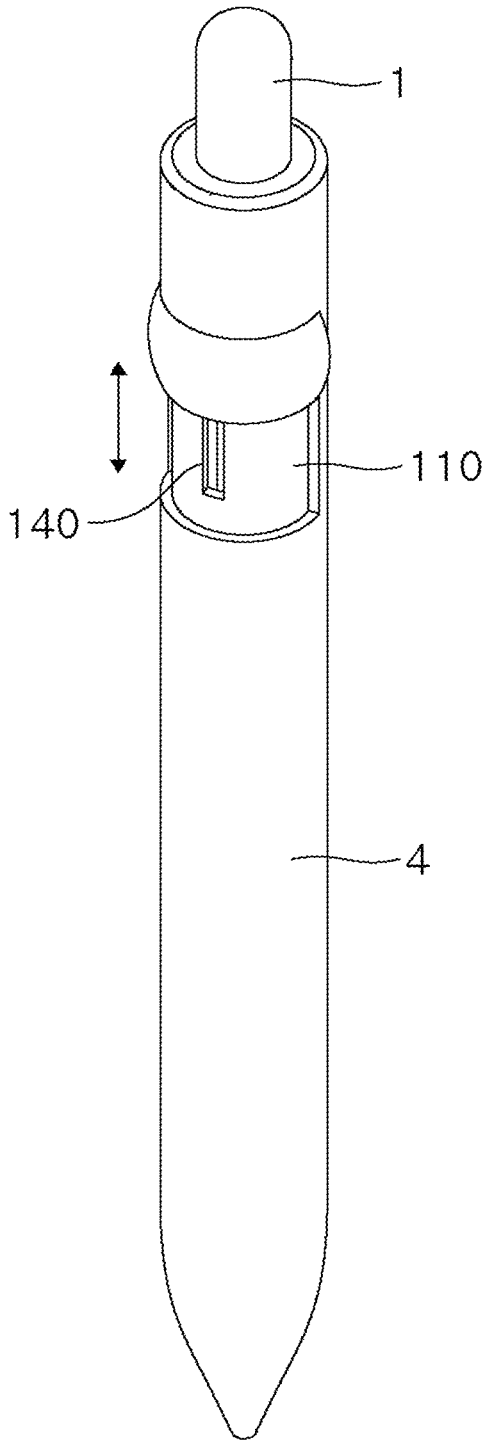

FIG. 5 is a perspective view of a knock type pen according to an embodiment of the present disclosure.

Figure 6:
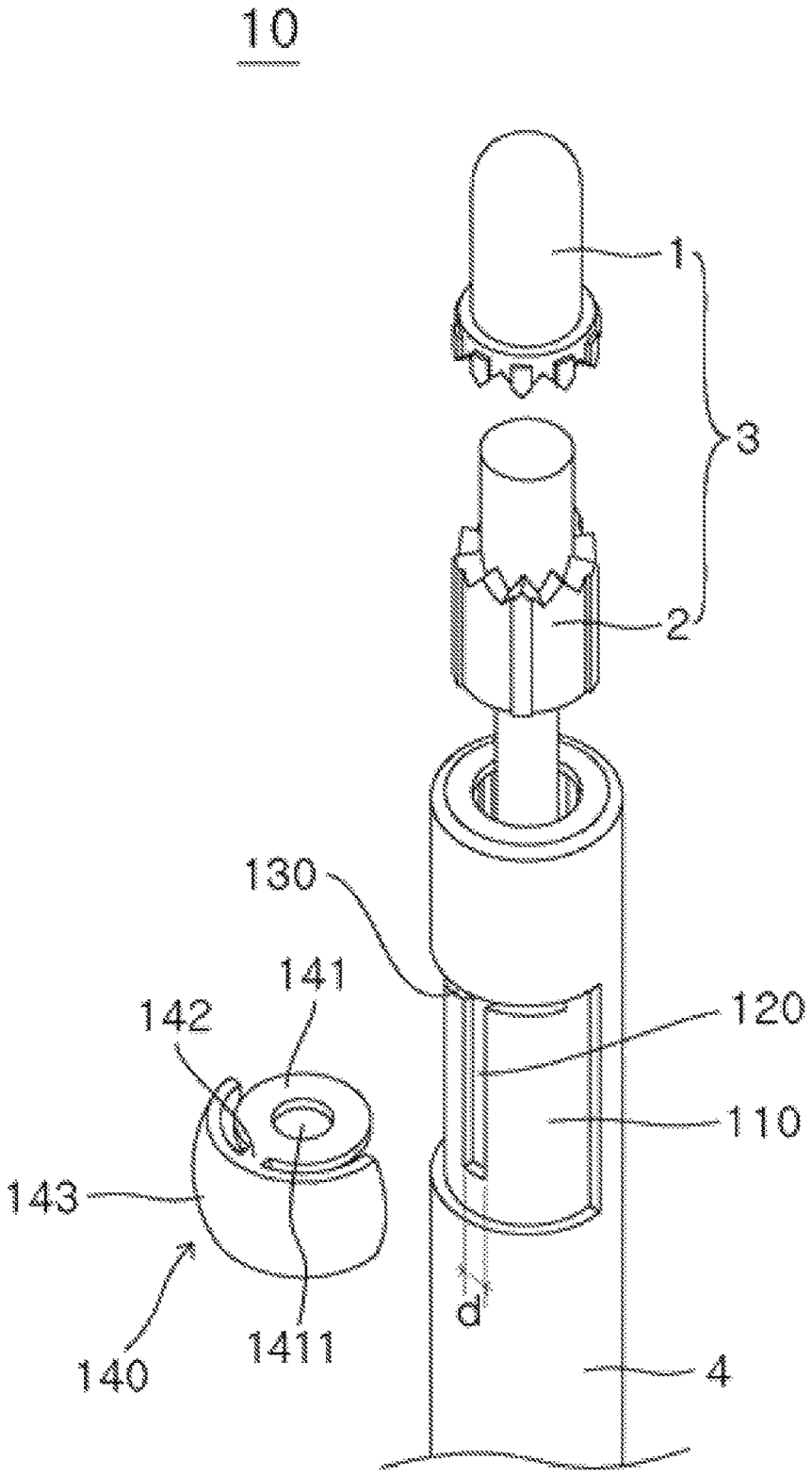

FIG. 6 is an exploded perspective view of a knock type pen according to an embodiment of the present disclosure.

Figure 7:
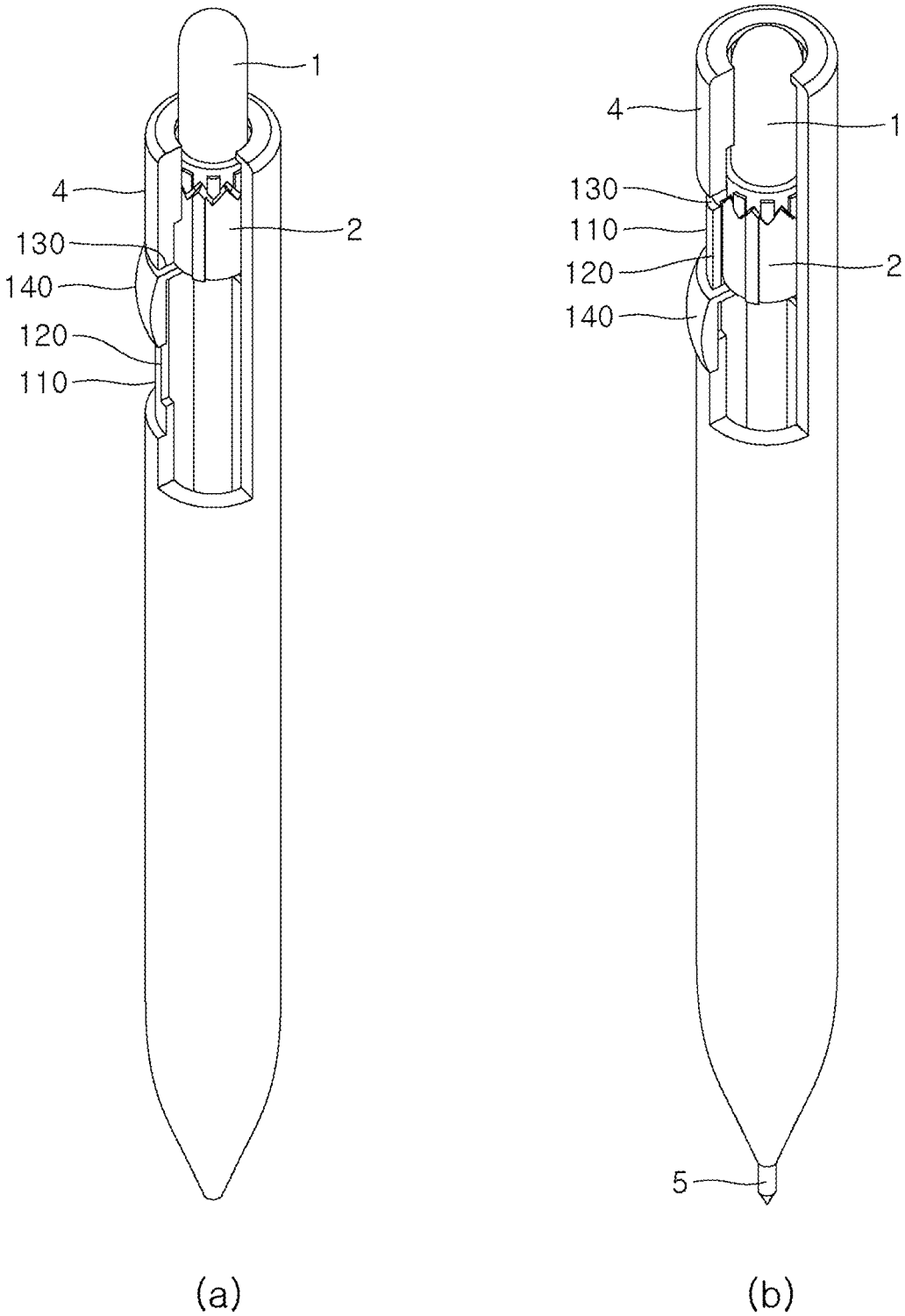

FIG. 7 is a cutaway perspective view showing the operation state of a knock type pen according to an embodiment of the present disclosure.

Figure 8:
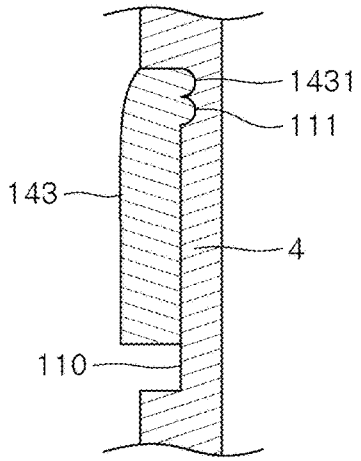

FIG. 8 is a cross-sectional view of a knock type pen according to a variation embodiment of the present disclosure.

Figure 9:
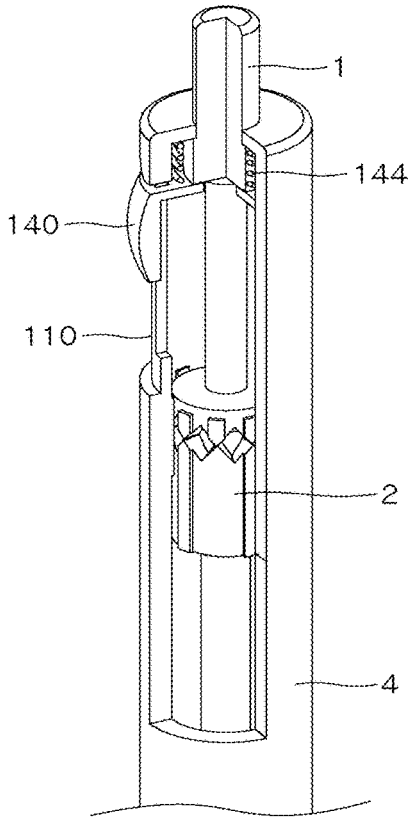

FIG. 9 is a cutaway perspective view of a knock type pen according to another embodiment of the present disclosure.

In the following description, the same or similar elements are labeled with the same or similar reference numbers.

DETAILED DESCRIPTION

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In addition, a term such as a "unit", a "module", a "block" or like, when used in the specification, represents a unit that processes at least one function or operation, and the unit or the like may be implemented by hardware or software or a combination of hardware and software.

Reference herein to a layer formed "on" a substrate or other layer refers to a layer formed directly on top of the substrate or other layer or to an intermediate layer or intermediate layers formed on the substrate or other layer. It will also be understood by those skilled in the art that structures or shapes that are "adjacent" to other structures or shapes may have portions that overlap or are disposed below the adjacent features.

In this specification, the relative terms, such as "below", "above", "upper", "lower", "horizontal", and "vertical", may be used to describe the relationship of one component, layer, or region to another component, layer, or region, as shown in the accompanying drawings. It is to be understood that these terms are intended to encompass not only the directions indicated in the figures, but also the other directions of the elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

FIG. 5 is a perspective view of the knock type pen according to an embodiment of the present disclosure, FIG. 6 is an exploded perspective view of the knock type pen according to an embodiment of the present disclosure, FIG. 7 is a cutaway perspective view showing the operation state of the knock type pen according to an embodiment of the present disclosure, and FIG. 8 is a cross-sectional view of the knock type pen according to a variation embodiment of the present disclosure.

Describing with reference to FIGS. 5 to 8, the knock type pen includes a slit hole 120, an insert hole 130 and a locking section 140. Although the present disclosure forms the body 4 in a cylindrical shape, the body may be formed in a polygonal shape, and the shape is not limited thereto.

A cutout groove 110 extends to a predetermined distance in one direction along the axial direction of the body 4 with a predetermined thickness relative to the outer diameter thickness of the body 4 in the rear end part of the body 4. The cutout groove 110 may play a role in guiding the movement of the locking section 140 described below.

The slit hole 120 extends along the vertical direction from the upper end of the cutout groove 110. The slit hole 120 may be relatively short compared to the length of the cutout groove 110, but the length is not limited thereto.

The insert hole 130 is formed in a direction perpendicular to the slit hole 120 from the upper end of the cutout groove 110. The insert hole 130 plays a role in guiding the insertion of the movement plate 141 of the locking section 140 when coupling the locking section 140.

The locking section 140 moves up and down along the slit hole 120, and when the operation of the knock section 3 is in released state, the locking section 140 limits the movement of the knock section 3 in one direction to prevent the lead from extending outside the body 4, and includes a movement plate 141, a protrusion 142 and a guide plate 143.

The movement plate 141 is formed in plate shape, and has a hole 1411 that can guide the movement of the lead. When the locking section 140 is disposed upward, the movement plate 141 may prevent the knock section 3 from arbitrary moving in the downward direction. In this instance, because the movement plate 141 has the hole 1411, when the lead moves in the downward direction through the knock section 3, the movement plate 141 guides the movement of the upper end of the lead, allowing for the smooth operation of the knock section 3.

The protrusion 142 integrally extends in the outer radial direction of the width d of the slit hole 120 from the outer circumferential surface of the movement plate 141. That is, when the protrusion 142 is inserted into the slit hole 120 and moves in the upward and downward directions, the movement plate 141 and the guide plate 143 placed in two directions of the protrusion 142 move in the upward and downward directions.

The inner circumferential surface of the guide plate 143 is coupled to the tip of the protrusion 142, and the guide plate 143 is formed in a shape corresponding to the shape of the outer circumferential surface of the cutout groove 110 and moves up and down along the cutout groove 110. In the present disclosure, the guide plate 143 is formed in cutaway semi-cylindrical shape to conform to the body 4 formed in cylindrical shape, but in case that the body 4 is formed in rectangular shape, the guide plate 143 may be formed in cutaway semi-rectangular shape, and the shape is not limited thereto. The guide plate 143 is in close contact with the cutout groove 110 when moving up and down, disallowing the knock section 3 disposed on the top of the body 4 to easily move by the friction force with the cutout groove 110, and to increase the friction force, the surface at which they come in contact with each other may be coated with different materials.

In this instance, to temporarily fix the movement in the downward direction when the locking section 140 is disposed at the upper end of the cutout groove 110, the upper end of the cutout groove 110 may have at least one semi-hole groove 111 successively formed in the vertical direction along the circumferential direction of a contact area with the guide plate 143, and the upper end of the guide plate 143 may have a projection 1431 formed in hemispheric shape at a position corresponding to a contact area with the semi-hole groove 111.

Accordingly, the knock type pen according to the embodiment of the present disclosure can prevent ink from leaking through the nib pushed out by a user's unintentional knock pressing and leaving stains on clothes or a bag. In particular, in the case of use from low viscosity ink (300-3,000 cps) having relatively low viscosity to high viscosity ink (10,000-25,000 cps) having high viscosity, it can prevent ink from leaking out of the nib due to a knock pressing and leaving stains on clothes or a bag, and it can be applied to all writing instruments such as ballpoint pens employing low viscosity ink and high viscosity ink.

FIG. 9 is a cutaway perspective view of a knock type pen according to another embodiment of the present disclosure.

Hereinafter, the knock type pen according to another embodiment of the present disclosure is described with reference to FIG. 9.

The knock type pen according to another embodiment of the present disclosure has substantially the same structure as the cutout groove 110, the slit hole 120, the insert hole 130 formed in the body 4 described above, and a detailed description of overlapping parts is omitted below.

The cutout groove 110 is in a relatively higher position toward the upper end of the body 4 than the previous embodiment. Accordingly, the locking section 140 is also placed in a relatively high position, and the knock section 3 including the lower end of the knock body 1 and the rotary cam 2 is placed and operates below the locking section 140.

In this instance, in addition to the movement plate 141, the protrusion 142 and the guide plate 143 described above, the locking section 140 further includes a locking spring 144. Here, the movement plate 141, the protrusion 142 and the guide plate 143 are the same as the foregoing, and its detailed description is omitted below.

One end of the locking spring 144 is connected to the movement plate 141, and the other end is connected to the tip of the body 4. In this instance, when the operation of the knock section 3 is in released state, because one end of the locking spring 144 is fixed to the tip of the body 4, the locking spring 144 elastically fixes the movement plate 141, thereby preventing the movement plate 141 from easily operating. Accordingly, it can prevent ink from leaking through the nib pushed out by the user's unintentional knock pressing and leaving stains on clothes or a bag. In particular, when it is used in the knock type pen using low viscosity ink having relatively low viscosity, it can prevent ink from leaking from the pen due to a knock pressing and leaving stains on clothes or a bag.

On the contrary, the locking spring 144 extends with the movement of the movement plate 141 in the downward direction to operate through the operation of the knock section 3. In this instance, preferably the elastic force of the locking spring 144 is smaller than the elastic force of the spring that provides the elastic force to the lead. Through this, the resilient force of the locking spring 144 is relatively smaller than the elastic force of the lead, thereby preventing the lead from retracting into the body 4 due to the locking spring 144 when the lead is extended outside.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A knock type pen comprising a body in which a lead and a spring which provides an elastic force to the lead are received, and a knock section which is coupled to a rear end part of the body and includes a knock body and a rotary cam to push the lead out of a front end of the body or receive the lead inside of the body, the knock type pen comprising:

a cutout groove which extends to a predetermined distance in one direction along an axial direction of the body with a predetermined thickness relative to an outer diameter thickness of the body in the rear end part of the body;

a slit hole which extends along a vertical direction from an upper end of the cutout groove;

an insert hole which is formed in a direction perpendicular to the slit hole from the upper end of the cutout groove; and a locking section which moves up and down along the slit hole, wherein when operation of the knock section is in released state, the locking section limits a movement of the knock section in one direction to prevent the lead from being pushed out of the body.

2. The knock type pen of claim 1, wherein the locking section comprises:

a movement plate which is formed in plate shape, has a hole to guide a movement of the lead, and moves up and down;

a protrusion which extends in an outer radial direction of a width of the slit hole from an outer circumferential surface of the movement plate; and a guide plate having an inner circumferential surface coupled to a tip of the protrusion, wherein the guide plate is formed in a shape corresponding to a shape of an outer circumferential surface of the cutout groove and moves up and down along the cutout groove.

3. The knock type pen of claim 2, wherein the upper end of the cutout groove has at least one semi-hole groove successively formed in a vertical direction along a circumferential direction of a contact area with the guide plate, wherein an upper end of the guide plate has a projection in hemispheric shape temporarily fixed to the semi-hole groove at a position corresponding to a contact area with the semi-hole groove.

* * * * *